US009310164B2

(12) United States Patent
Siedal

(10) Patent No.: US 9,310,164 B2
(45) Date of Patent: Apr. 12, 2016

(54) FASTENER TARGETING SYSTEM

(71) Applicant: David S. Siedal, Granbury, TX (US)

(72) Inventor: David S. Siedal, Granbury, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 47 days.

(21) Appl. No.: 14/478,139

(22) Filed: Sep. 5, 2014

(65) Prior Publication Data

US 2016/0069646 A1 Mar. 10, 2016

(51) Int. Cl.
*F41G 3/24* (2006.01)

(52) U.S. Cl.
CPC ..... *F41G 3/24* (2013.01)

(58) Field of Classification Search
CPC ..... F41G 1/12; F41G 3/24; G02B 27/32; G02B 27/34
USPC ..... 33/229, 297, 298, 613, 645
See application file for complete search history.

(56) References Cited

U.S. PATENT DOCUMENTS

| | | | | |
|---|---|---|---|---|
| 3,861,807 | A | 1/1975 | Lescrenier | |
| 4,912,853 | A * | 4/1990 | McDonnell | G01C 1/00 33/1 B |
| 5,920,995 | A * | 7/1999 | Sammut | F41G 1/38 42/122 |
| 7,304,728 | B2 | 12/2007 | Chang et al. | |
| 7,379,077 | B2 | 5/2008 | Bani-Hashemi et al. | |
| 7,434,345 | B2 | 10/2008 | Verdugo | |
| 7,633,628 | B2 | 12/2009 | Seko | |
| 7,770,303 | B2 | 8/2010 | Graham et al. | |
| 7,877,886 | B1 * | 2/2011 | Hamilton | F41G 1/12 33/297 |
| 2002/0124452 | A1 * | 9/2002 | Sammut | F41G 1/38 42/122 |
| 2009/0153862 | A1 * | 6/2009 | Lecoq | G01M 11/0264 356/401 |
| 2009/0223354 | A1 * | 9/2009 | Root, Jr. | G01S 7/22 89/1.11 |
| 2012/0180367 | A1 | 7/2012 | Singh | |
| 2014/0090259 | A1 * | 4/2014 | Stockdill | F41G 1/44 33/298 |

FOREIGN PATENT DOCUMENTS

| | | |
|---|---|---|
| JP | H02112223 | 4/1990 |

* cited by examiner

*Primary Examiner* — G. Bradley Bennett
(74) *Attorney, Agent, or Firm* — Baker Botts L.L.P.

(57) ABSTRACT

An apparatus includes a first end and a second end opposed to the first end. A body connects the first end to the second end. The second end includes a mark in a center of the second end, a first plurality of marks positioned on a first axis, a second plurality of marks positioned on the first axis on an opposite side of the center mark as the first plurality of marks, a third plurality of marks positioned on a second axis, a fourth plurality of marks positioned on the second axis on an opposite side of the center mark as the third plurality of marks, a fifth plurality of marks positioned on a third axis, and a sixth plurality of marks positioned on the third axis on an opposite side of the center mark as the fifth plurality of marks.

20 Claims, 4 Drawing Sheets

FASTENER TARGETING SYSTEM

TECHNICAL FIELD

This disclosure generally relates to optics, and more particularly to a fastener targeting system.

BACKGROUND

Many objects use fasteners to attach components. For example, a fastener may attach the outer skin of an aircraft to the aircraft structure. Because fasteners may operate in tough environments, they often need to be removed and replaced.

BRIEF DESCRIPTION OF THE DRAWINGS

For a more complete understanding of the present disclosure and for further features and advantages thereof, reference is now made to the following description taken in conjunction with the accompanying drawings, in which.

DETAILED DESCRIPTION

Figure 1:
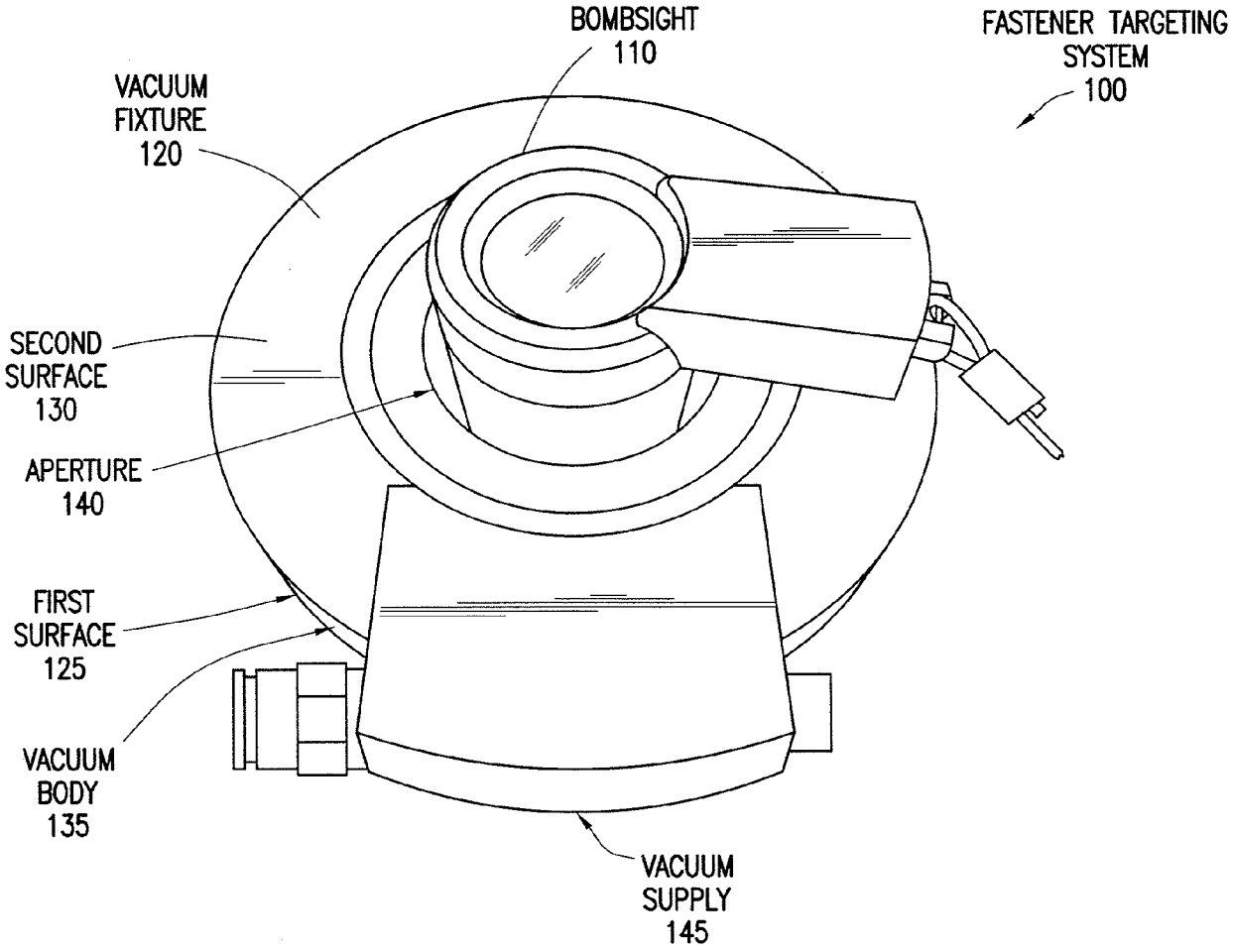
FIG. 1 is a diagram illustrating an example fastener targeting system, according to certain embodiments of the present disclosure.

Many objects include fasteners that attach components. For example, an aircraft may have a fastener that attaches the outer skin to the aircraft structure. As another example, a boat may have a fastener that attaches a component of the hull to the boat structure. Those fasteners operate in tough environments that may cause the fasteners to wear. As a result, the fasteners need to be replaced by targeting the fastener with a fastener targeting system and then using a drill to remove the fastener. Given the importance of the structural integrity of the object (e.g., the outer skin of the aircraft), removing the fastener without damaging the structure of the object is crucial.

Accordingly, aspects of the present disclosure include an apparatus that, in one embodiment, includes a first end, a second end opposed to the first end, and a body connecting the first end to the second end. The second end includes a mark in a center of the second end, a first plurality of marks positioned on a first axis intersecting the center mark, a second plurality of marks positioned on the first axis on an opposite side of the center mark as the first plurality of marks, a third plurality of marks positioned on a second axis, a fourth plurality of marks positioned on the second axis on an opposite side of the center mark as the third plurality of marks, a fifth plurality of marks positioned on a third axis, and a sixth plurality of marks positioned on the third axis on an opposite side of the center mark as the fifth plurality of marks. The second axis may intersect the center mark and may be perpendicular to the first axis, and the third axis may intersect the center mark and the first axis at an angle. Additionally, the center mark, and the first, second, third, fourth, fifth, and sixth plurality of marks are configured to align the apparatus with a fastener.

The fastener targeting system of the present disclosure may provide numerous advantages. For example, using a plurality of dots rather than continuous lines prevents obstruction of the outer edges of the fastener. As a result, the fastener targeting system can be accurately aligned so that a drill can remove the fastener without damaging the object containing the fastener. And because the object is not damaged during removal, the structural integrity of the object is maintained, which is important for objects where small structural defects can be catastrophic (e.g., an aircraft). As another example, accurately targeting a fastener for removal saves money as additional money will not be required to fix structural damage of the object due to misalignment. As yet another example, the fastener targeting system may include several dots at different distances from the center dot thereby allowing for a flexible fastener targeting system that can be used with fasteners having different diameters. As another example, the fastener targeting system allows for quick location and alignment of a fastener thereby saving time and reducing labor costs.

Figure 2:
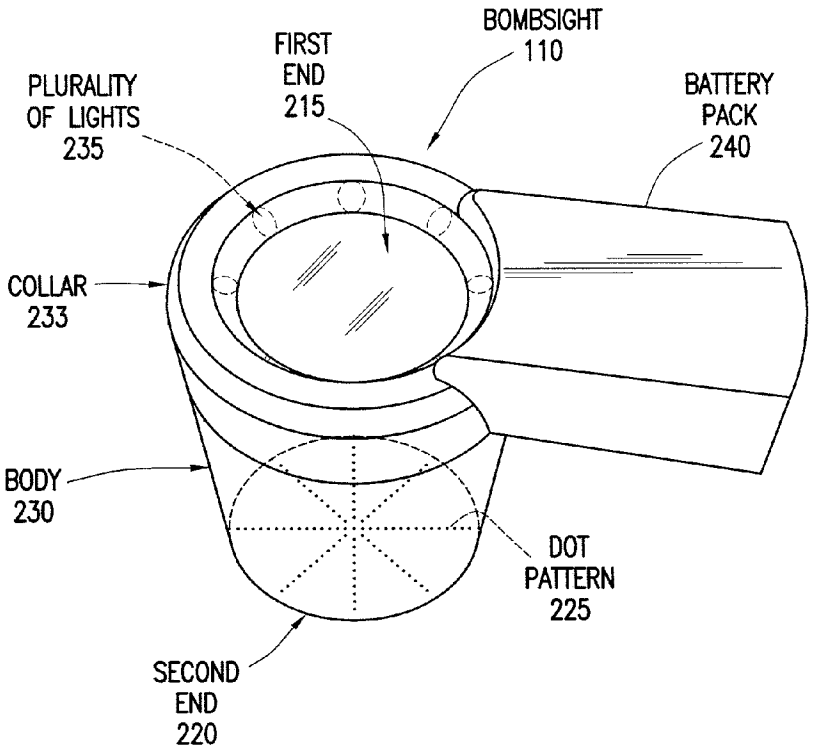
FIG. 2 is an example bombsight used in the fastener targeting system of FIG. 1, according to certain embodiments of the present disclosure.
Figure 3:
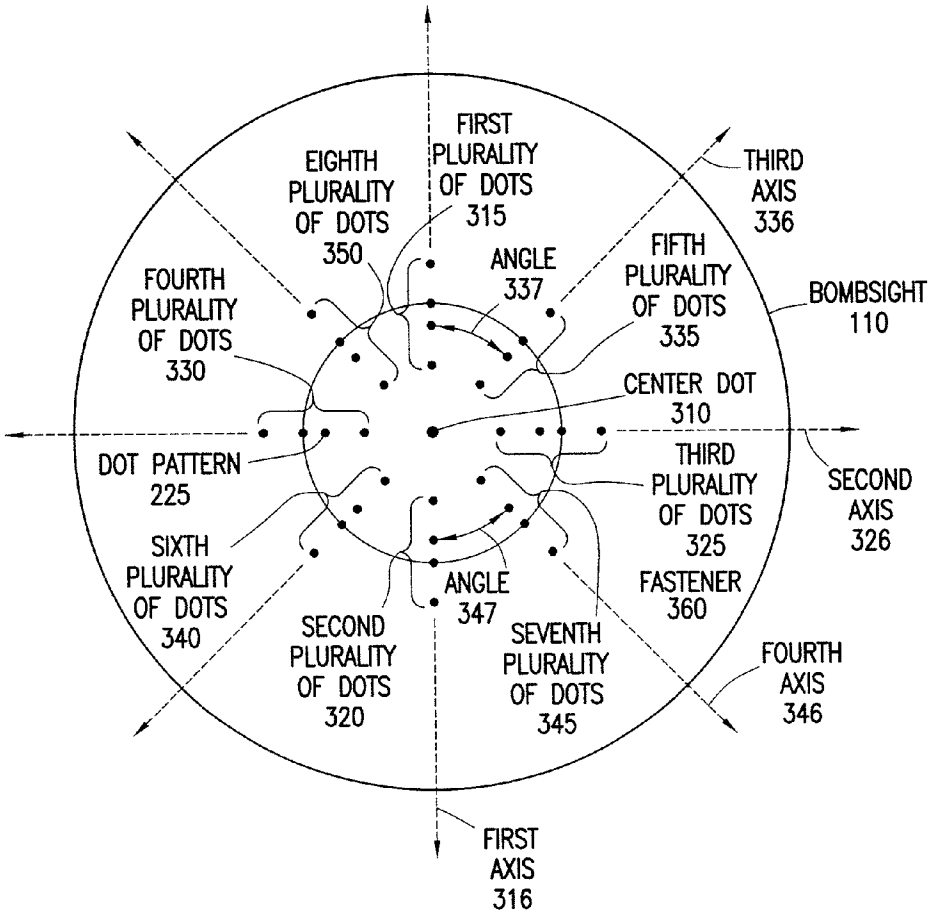
FIG. 3 is a top view of the example bombsight of FIG. 2, according to certain embodiments of the present disclosure.
Figure 4:
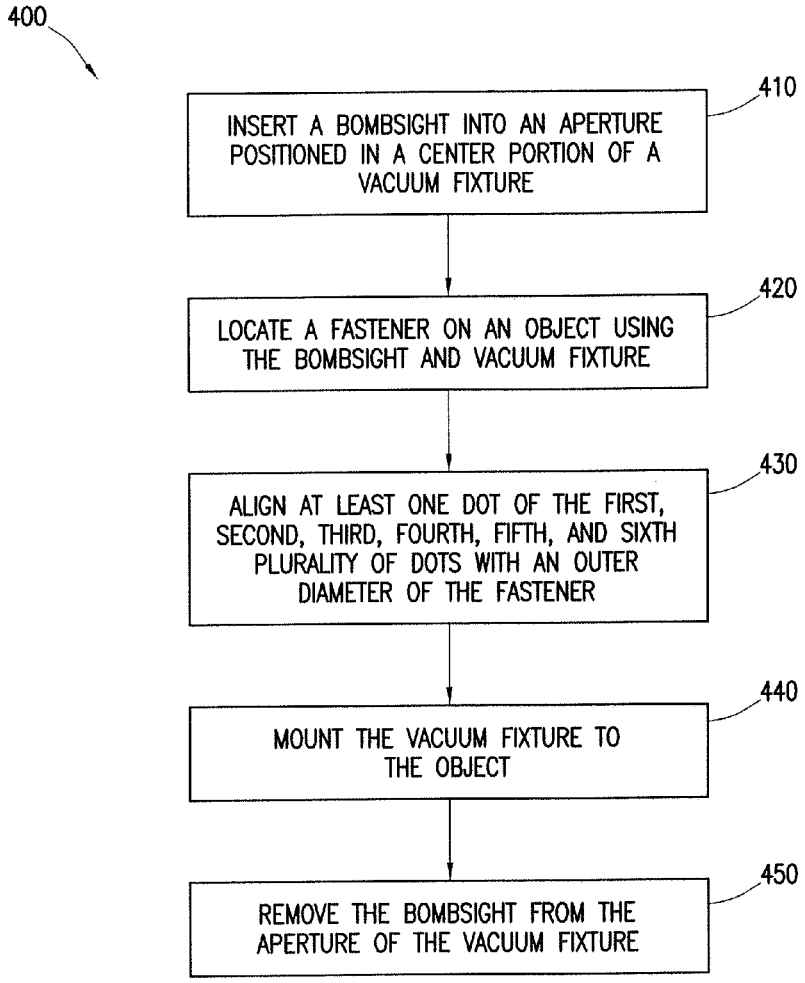
FIG. 4 is a flow chart illustrating an example method of using the fastener targeting system of FIG. 1, according to certain embodiments of the present disclosure.

Additional details are discussed in FIGS. 1 through 4. FIG. 1 illustrates an example fastener targeting system 100, and FIG. 2 shows an example bombsight 110 that may be used in the example fastener targeting system 100 of FIG. 1. FIG. 3 shows a top view of the example bombsight 110 of FIG. 2. FIG. 4 shows an example method of using fastener targeting system 100.

FIG. 1 illustrates an example fastener targeting system 100, according to certain embodiments of the present disclosure. As described in more detail below, fastener targeting system 100 may be used to quickly and accurately locate and align bombsight 110 with fastener 360 (shown in FIG. 3). Once fastener targeting system 100 is aligned with fastener 360, bombsight 110 may be removed and replaced with a drill for removing fastener 360. Fastener targeting system 100 may include bombsight 110 and vacuum fixture 120 in certain embodiments.

Bombsight 110, which is discussed in detail with respect to FIGS. 2 and 3, may be a component used to align vacuum fixture 120 with fastener 360 using dot pattern 225 (shown in FIGS. 2 and 3). Bombsight 110 may be inserted into aperture 140 of vacuum fixture 120 in an embodiment. In that embodiment, bombsight 110 may be secured to vacuum fixture 120 using a friction fit or slip fit. In other embodiments, bombsight 110 may be screwed into aperture 140 of vacuum fixture 120.

Vacuum fixture 120 may generally be used to provide vacuum pressure so that vacuum fixture 120 can be mounted to an object. For example, vacuum fixture 120 may be mounted to an aircraft by pressing down on second surface 130. Additionally, vacuum fixture 120 may generally be configured to receive bombsight 110 and thus provide an accurate location of fastener 360 so that a drill can be inserted into aperture 140 of vacuum fixture 120 to remove fastener 360. Vacuum fixture 120 may be made of any material, such as plastic or metal. Vacuum fixture 120 may be any shape, such as circular, rectangular, square, or any other shape. Vacuum fixture 120 may include first surface 125, second surface 130, vacuum body 135, aperture 140, and vacuum supply 145 in certain embodiments.

First surface 125 may be a surface configured to mount to an object in certain embodiments. First surface 125 may be a flat surface in some embodiments. In other embodiments, first surface 125 may be shaped to conform to a particular surface of an object (e.g., curved). First surface 125 may be opposed to second surface 130 and coupled to second surface 130 by vacuum body 135.

Second surface 130 may be a surface configured to receive a pressure from a user that triggers a vacuum pressure. For example, a user may press on second surface 130 thereby causing vacuum fixture 120 to mount to an object. Second surface 130 may be configured to secure various other components, such as vacuum supply 145. Second surface 130 may be opposed to first surface 125 and coupled to first surface 125 by vacuum body 135.

Vacuum body 135 may couple first surface 125 to second surface 130 in certain embodiments. Vacuum body 135 may be any thickness. In some embodiments, vacuum body 135 has a thickness that is less than the height of bombsight 110. Vacuum body 135 may be made of any type of material. Vacuum body 135 may include aperture 140 in certain embodiments.

Aperture 140 may be configured to receive bombsight 110 in certain embodiments. For example, aperture 140 may be configured to receive bombsight 110 via a friction or slip fit. As another example, aperture 140 may be configured to receive bombsight 110 by screwing bombsight 110 into aperture 140. Aperture 140 may be positioned in a center portion of vacuum fixture 120. Aperture 140 may extend through first surface 125, second surface 130, and vacuum body 135 such that bombsight 110 may be inserted in vacuum fixture 120 and a user can see fastener 360 below first surface 125.

Vacuum supply 145 may generally be any component configured to provide vacuum pressure sufficient to allow vacuum fixture 120 to mount to an object in an embodiment. In some embodiments, vacuum supply 145 may be triggered by a user pressing on second surface 130.

As an example embodiment of operation, a user may insert bombsight 110 into aperture 140 of vacuum fixture 120. The user may then locate fastener 360 on an object and align bombsight 110 with the outer edges of fastener 360. Once bombsight 110 is properly aligned, the user may mount vacuum fixture 120 to the object. The user may then remove bombsight 110 and then insert a drill into aperture 140 to remove fastener 360.

FIG. 2 illustrates an example bombsight 110 used in the fastener targeting system 100 of FIG. 1, according to certain embodiments of the present disclosure. Bombsight 110 may generally be used to accurately locate fastener 360 and align bombsight 110 (and thus vacuum fixture 120) with an outer diameter of fastener 360. Bombsight 110 may be made of an acrylic material in some embodiments. However, bombsight 110 may be made of any other transparent material. Bombsight 110 may include first end 215, second end 220, dot pattern 225, and body 230 in certain embodiments. Additionally, in some embodiments, bombsight 110 may include collar 233, plurality of lights 235, and battery pack 240.

First end 215 may be configured such that a user can easily look into bombsight 110 and see dot pattern 225 in some embodiments. First end 215 may have a rounded surface so that it provides a larger viewing angle for the user in some embodiments. Such a larger viewing angle provides the advantage that a user does not have to be directly over the top of bombsight 110 to see dot pattern 225. However, in other embodiments, first end 215 may have a flat surface. First end 215 may be larger in diameter than second end 220 in some embodiments. Such a larger diameter not only provides for a larger viewing angle, but also ensures a proper slip fit in aperture 140 of vacuum fixture 120. First end 215 may be circular in some embodiments. In other embodiments, first end 215 may be any shape, such as a square, rectangle, or triangle. First end 215 may be coupled to collar 233 and battery pack 240 (both discussed below) in some embodiments. First end may be opposed to second end 220 and coupled to second end 220 with body 230.

Second end 220 may be configured to include dot pattern 225 in some embodiments. Second end 220 may be smaller in diameter than first end 215 in an embodiment. Second end 220 may be circular in an embodiment. However, second end 220 may be any shape, such as a square, rectangle, or triangle. Second end 220 may be the same shape as first end 215 in some embodiments. Second end 220 may be opposed to first end 215 and coupled to first end 215 with body 230.

Body 230 may be any structure configured to couple first end 215 to second end 220 and secure bombsight 110 to aperture 140 of vacuum fixture 120 in an embodiment. Body 230 may be made of the same material as first end 215 and second end 220 in some embodiments. For example, first end 215, second end 220, and body 230 may all be made of an acrylic material.

As noted above, bombsight 110 may include collar 233, plurality of lights 235, and battery pack 240 in some embodiments. Collar 233 may be coupled to first end 215 in some embodiments. For example, collar 233 may be molded onto first end 215. As another example, collar 233 may be a separate component that is attached to first end 215 by a slip or friction fit. As yet another example, collar 233 may screw onto first end 215. Collar 233 may be any material, such as a plastic or metal. Collar 233 may be a similar shape as first end 215 in an embodiment. In other embodiments, collar 233 may be any shape, such as a square, rectangle, triangle, or circle. Collar 233 may include plurality of lights 235 in an embodiment.

Plurality of lights 235 may provide a light source directed towards second end 220 to illuminate fastener 360 in an embodiment. Plurality of lights 235 may be positioned under collar 233 in an embodiment. In certain embodiments, plurality of lights 235 may be LED lights. Such lights provide efficiency and save money, particularly when powered by a mobile power source, such as battery pack 240. In other embodiments, plurality of lights 235 may be mounted to body 230 of bombsight 110 rather than under collar 233. For example, plurality of lights 235 may be coupled to the inside or outside of body 230 so long as plurality of lights 235 direct light towards second end 220. Plurality of lights 235 may be powered using batteries held in battery pack 240 in an embodiment.

Battery pack 240 may be any component configured to hold a battery source in an embodiment. Battery pack 240 may extend outward from collar 233 such that battery pack 240 is cantilevered in certain embodiments. Battery pack 240 may be configured to hold any type of battery in an embodiment. Battery pack 240 may hold any number of batteries in an embodiment. Battery pack 240 may be made of the same material as collar 233 in an embodiment. For example, battery pack 240 may be a plastic or metal in an embodiment. Battery pack 240 may be any shape in certain embodiments. As noted above, batteries within battery pack 240 may provide power to plurality of lights 235.

FIG. 3 is a top view of the example bombsight 110 of FIG. 2, according to certain embodiments of the present disclosure. As noted above, bombsight 110 generally includes dot pattern 225. Dot pattern 225 may be used to align bombsight 110 (and thus vacuum fixture 120) with fastener 360 in an embodiment. Using dot pattern 225 rather than continuous lines prevents obstruction of the outer diameter of fastener 360 thereby providing a more accurate alignment with fastener 360. By accurately aligning bombsight 110 with fastener 360, damage to the object containing fastener 360 is prevented during removal of fastener 360.

Dot pattern 225 may be machined onto the bottom of second end 220 in certain embodiments. For example, dot pattern 225 may be a dimple or recess on an outer surface of second end 220. Dot pattern 225 may be formed using a drill bit in certain embodiments. Each dot in dot pattern 225 may include reflective paint in the recess or dimple in an embodiment. Dot pattern 225 may include center dot 310, first plurality of dots 315, second plurality of dots 320, third plurality of dots 325, fourth plurality of dots 330, fifth plurality of dots 335, sixth plurality of dots 340, seventh plurality of dots 345, and eighth plurality of dots 350 in an embodiment. Additionally, the first, second, third, fourth, fifth, and sixth (and seventh and eighth in embodiments including those groups of dots) plurality of dots have respective dots forming a plurality of concentric rings around center dot 310. For example, the dots in each of these groups that are closest to center dot 310 form a ring that is concentric with center dot 310 and a ring that is formed by dots in these groups that are furthest from center dot 310. While the dots are described as forming a ring, the actual bombsight 110 does not have visible rings. Although illustrated as having eight groups of plurality of dots, any number of groups of plurality of dots may be used. For example, bombsight 110 may include only four groups of plurality of dots.

Center dot 310 may be in the center of dot pattern 225 in an embodiment. Center dot 310 may provide a quick reference for locating the center of fastener 360. Center dot 310 may be the same size as other dots in dot pattern 225 in an embodiment. However, center dot 310 may be larger or smaller than other dots in other embodiments. Center dot 310 may be positioned on first axis 316, second axis 326, third axis 336, and fourth axis 346 in certain embodiments.

First plurality of dots 315 may be positioned on first axis 316 in an embodiment. Each of the dots in first plurality of dots 315 may be spaced at a distance from the other dots in first plurality of dots 315. Those distances may not be uniform in some embodiments. For example, the first and second dots in first plurality of dots 315 may be spaced an eighth of an inch apart while the third and fourth dots in first plurality of dots 315 may be spaced a quarter inch apart. In some embodiments, the spacing between dots depends on the diameters of fasteners being used. In particular, each of the dots in first plurality of dots 315 may correspond to a different diameter of fastener 360. For example, if a user uses multiple diameters of fasteners 360, the user can customize bombsight 110 to include dots spaced according to the diameters of the fasteners 360. First plurality of dots 315 may include any number of dots corresponding to the different number of fasteners 360 used. For example, if the user knows there are five different diameter fasteners 360 in use, the user may customize first plurality of dots 315 to include five different dots each spaced according to a diameter of one particular fastener 360. Although illustrated and described as dots, hash marks or marks of any other shape (e.g., square, triangle, etc.) may be used.

First axis 316 may intersect first plurality of dots 315, center dot 310, and second plurality of dots 320 in an embodiment.

Second plurality of dots 320 may be positioned on first axis 316 on an opposite side of center dot 310 as first plurality of dots 315 in an embodiment. Second plurality of dots 320 may have the same features as described with reference to first plurality of dots 315.

Third plurality of dots 325 may be positioned on second axis 326 in an embodiment. Third plurality of dots 325 may have the same features as described with reference to first plurality of dots 315.

Second axis 326 may intersect third plurality of dots 325, center dot 310, and fourth plurality of dots 330 in an embodiment. Additionally, second axis 326 may be perpendicular to first axis 316 in an embodiment.

Fourth plurality of dots 330 may be positioned on second axis 326 on an opposite side of center dot 310 as third plurality of dots 325 in an embodiment. Fourth plurality of dots 330 may have the same features as described with reference to first plurality of dots 315.

Fifth plurality of dots 335 may be positioned on third axis 336 in an embodiment. Fifth plurality of dots 335 may have the same features as described with reference to first plurality of dots 315.

Third axis 336 may intersect fifth plurality of dots 335, center dot 310, and sixth plurality of dots 340 in an embodiment. Third axis 336 may be perpendicular to fourth axis 346 in an embodiment. Third axis 336 may intersect first axis 316 and second axis 326 at angle 337. For example, third axis 336 may intersect first axis 316 and second axis 326 at a forty-five degree angle.

Sixth plurality of dots 340 may be positioned on third axis 336 on an opposite side of center dot 310 as fifth plurality of dots 335 in an embodiment. Sixth plurality of dots 340 may have the same features as described with reference to first plurality of dots 315.

Seventh plurality of dots 345 may be positioned on fourth axis 346 in an embodiment. Seventh plurality of dots 345 may have the same features as described with reference to first plurality of dots 315.

Fourth axis 346 may intersect seventh plurality of dots 345, center dot 310, and eighth plurality of dots 350 in an embodiment. Fourth axis 346 may be perpendicular to third axis 336 in an embodiment. Fourth axis 346 may intersect first axis 316 and second axis 326 at angle 347. For example, fourth axis 346 may intersect first axis 316 and second axis 326 at a forty-five degree angle.

Eighth plurality of dots 350 may be positioned on fourth axis 346 on an opposite side of center dot 310 as seventh plurality of dots 345 in an embodiment. Eighth plurality of dots 350 may have the same features as described with reference to first plurality of dots 315.

Fastener 360 may be any fastener on any object. For example, fastener 360 may be a screw, a nail, a pin, or any other fastener. Fastener 360 may be located on any type of object, such as an aircraft, a car, a boat, a drone, or any other type of object.

As an example embodiment of operation, a user may locate fastener 360 and quickly find the center of fastener 360 using center dot 310. The user may then align dots in each of (or fewer than each of) the first, second, third, fourth, fifth, sixth, seventh, and eighth plurality of dots with an outer diameter of fastener 360. Once the user has properly aligned the desired number of dots with fastener 360, the user may press on vacuum fixture 120 to mount vacuum fixture 120 to the object. The user may then remove bombsight 110 from vacuum fixture 120 and insert a drill to remove fastener 360. Because the user accurately aligned bombsight 110 (and thus vacuum fixture 120) using dot pattern 225, the user can accurately remove fastener 360 without damaging the object.

FIG. 4 is a flow chart illustrating an example method 400 of using the fastener targeting system 100 of FIG. 1, according to certain embodiments of the present disclosure. Method 400 begins at step 410, where bombsight 110 is inserted into aperture 140 positioned in a center portion of vacuum fixture 120. In some embodiments, bombsight 110 may be inserted into aperture 140 using a friction or slip fit. In other embodiments, bombsight 110 may be screwed into aperture 140.

At step 420, fastener 360 is located on an object using bombsight 110 and vacuum fixture 120. For example, fastener 360 may be located when fastener 360 is visually seen within the view of bombsight 110. As another example, fastener 360 may be located when center dot 310 is positioned over fastener 360.

At step 430, at least one dot of the first, second, third, fourth, fifth, and sixth plurality of dots are aligned with an outer diameter of fastener 360. For example, a user may align one dot of first plurality of dots 315 and a corresponding dot of second plurality of dots 320 with an outer diameter of fastener 360. A user may choose to align any number of dots with an outer diameter of fastener 360.

At step 440, vacuum fixture 120 is mounted to the object. In some embodiments, vacuum fixture 120 may be mounted by pressing on second surface 130 of vacuum fixture 120 thereby triggering the vacuum system.

At step 450, bombsight 110 is removed from aperture 140 of vacuum fixture 120. Bombsight 110 may be removed by pulling bombsight 110 out of aperture 140 in an embodiment. In other embodiments, bombsight 110 may be removed by unscrewing bombsight 110 from aperture 140. Once bombsight 110 is removed, the user may insert a drill into aperture 140 to remove fastener 360.

As an example embodiment of operation, bombsight 110 is inserted in aperture 140. For example, bombsight 110 may be inserted into aperture 140 using a friction or slip fit. Fastener 360 may be located using bombsight 110 and vacuum fixture 120. For example, bombsight 110 may be positioned over fastener 360. At least one dot of the first, second, third, fourth, fifth, and six plurality of dots is aligned with an outer diameter of fastener 360. As noted above, a user may choose how many of these dots is aligned with an outer diameter of fastener 360. Vacuum fixture 120 may then be mounted to the object, and bombsight 110 may be removed from vacuum fixture 120. Once bombsight 110 is removed, the user may then insert a drill into aperture 140 and remove fastener 360.

Fastener targeting system 100 of the present disclosure may provide numerous advantages. For example, using a plurality of dots rather than continuous lines prevents obstruction of the outer edges of fastener 360. As a result, fastener targeting system 100 can be accurately aligned so that a drill can remove fastener 360 without damaging the object containing fastener 360. And because the object is not damaged during removal, the structural integrity of the object is maintained, which is important for objects where small structural defects can be catastrophic (e.g., an aircraft). As another example, accurately targeting fastener 360 for removal saves money as additional money will not be required to fix structural damage of the object due to misalignment. As yet another example, fastener targeting system 100 may include several dots at different distances from center dot 310 thereby allowing for a flexible fastener targeting system 100 that can be used with fasteners having different diameters. As another example, fastener targeting system 100 allows for quick location and alignment with fastener 360 thereby saving time and reducing labor costs.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications.

What is claimed is:

1. An apparatus, comprising:
- a first end;
- a second end opposed to the first end, the second end comprising:
  - a center mark in a center of the second end;
  - a first plurality of marks positioned on a first axis intersecting the center mark;
  - a second plurality of marks positioned on the first axis on an opposite side of the center mark as the first plurality of marks;
  - a third plurality of marks positioned on a second axis, the second axis intersecting the center mark and perpendicular to the first axis;
  - a fourth plurality of marks positioned on the second axis on an opposite side of the center mark as the third plurality of marks;
  - a fifth plurality of marks positioned on a third axis, the third axis intersecting the center mark and the first axis at a first angle; and
  - a sixth plurality of marks positioned on the third axis on an opposite side of the center mark as the fifth plurality of marks; and
- a body connecting the first end to the second end;
- wherein the center mark and the first, second, third, fourth, fifth, and sixth plurality of marks are configured to align the apparatus with a fastener.

2. The apparatus of claim 1, further comprising:
- a seventh plurality of marks positioned on a fourth axis, the fourth axis intersecting the mark and the first axis at a second angle; and
- an eighth plurality of marks positioned on the fourth axis on an opposite side of the center mark as the seventh plurality of marks.

3. The apparatus of claim 1, wherein the first, second, third, fourth, fifth, and sixth plurality of marks each comprise at least one of:
- a dot;
- a square;
- a triangle; and
- a hash.

4. The apparatus of claim 1, wherein the first, second, third, fourth, fifth, and sixth plurality of marks have respective marks forming a plurality of concentric rings around the center mark.

5. The apparatus of claim 1, further comprising:
- a collar coupled to the first end; and
- a plurality of lights positioned under the collar such that light is directed towards the second end.

6. The apparatus of claim 1, further comprising:
- a plurality of lights attached to the body such that light is directed towards the second end.

7. The apparatus of claim 1, wherein the center mark and the first, second, third, fourth, fifth, and sixth plurality of marks each comprise a recess on an outer surface of the second end.

8. The apparatus of claim 7, wherein the center mark and the first, second, third, fourth, fifth, and sixth plurality of marks each comprise a reflective paint in the recess.

9. A system, comprising:
- a bombsight comprising:
  - a first end;
  - a second end opposed to the first end, the second end comprising:
    - a center mark in a center of the second end;
    - a first plurality of marks positioned on a first axis intersecting the center mark;

a second plurality of marks positioned on the first axis on an opposite side of the center mark as the first plurality of marks;

a third plurality of marks positioned on a second axis, the second axis intersecting the center mark and perpendicular to the first axis;

a fourth plurality of marks positioned on the second axis on an opposite side of the center mark as the third plurality of marks;

a fifth plurality of marks positioned on a third axis, the third axis intersecting the center mark and the first axis at a first angle; and a sixth plurality of marks positioned on the third axis on an opposite side of the center mark as the fifth plurality of marks; and a body connecting the first end to the second end; and a vacuum fixture configured to receive the bombsight, the vacuum fixture comprising:

a first surface configured to mount to an object;

a second surface opposed to the first surface;

a vacuum body connecting the first surface to the second surface; and an aperture through the first surface, the second surface, and the vacuum body, the aperture configured to receive the bombsight;

wherein the center mark and the first, second, third, fourth, fifth, and sixth plurality of marks are configured to align the bombsight and the vacuum fixture with a fastener.

10. The system of claim 9, wherein the bombsight is removable from the aperture.

11. The system of claim 9, wherein the bombsight further comprises:

a seventh plurality of marks positioned on a fourth axis, the fourth axis intersecting the mark and the first axis at a second angle; and an eighth plurality of marks positioned on the fourth axis on an opposite side of the center mark as the seventh plurality of marks.

12. The system of claim 9, wherein the first, second, third, fourth, fifth, and sixth plurality of marks each comprise at least one of:

a dot;

a square;

a triangle; and a hash.

13. The system of claim 9, wherein the first, second, third, fourth, fifth, and sixth plurality of marks have respective marks forming a plurality of concentric rings around the center mark.

14. The system of claim 9, wherein the bombsight further comprises:

a collar coupled to the first end; and a plurality of lights positioned under the collar such that light is directed towards the second end.

15. The system of claim 9, wherein the bombsight further comprises a plurality of lights attached to the body of the bombsight such that light is directed towards the second end.

16. The system of claim 9, wherein the center mark and the first, second, third, fourth, fifth, and sixth plurality of marks each comprise a recess on an outer surface of the second end.

17. The system of claim 16, wherein the center mark and the first, second, third, fourth, fifth, and sixth plurality of marks each comprise a reflective paint in the recess.

18. A method, comprising:

inserting a bombsight into an aperture positioned in a center portion of a vacuum fixture, the bombsight comprising:

a first end;

a second end opposed to the first end, the second end comprising:

a center mark in a center of the second end;

a first plurality of marks positioned on a first axis intersecting the center mark;

a second plurality of marks positioned on the first axis on an opposite side of the center mark as the first plurality of marks;

a third plurality of marks positioned on a second axis, the second axis intersecting the center mark and perpendicular to the first axis;

a fourth plurality of marks positioned on the second axis on an opposite side of the center mark as the third plurality of marks;

a fifth plurality of marks positioned on a third axis, the third axis intersecting the center mark and the first axis at an angle; and a sixth plurality of marks positioned on the third axis on an opposite side of the center mark as the fifth plurality of marks; and a body connecting the first end to the second end;

locating a fastener on an object using the bombsight and the vacuum fixture;

aligning at least one mark of the first, second, third, fourth, fifth, and sixth plurality of marks with an outer diameter of the fastener;

mounting the vacuum fixture to the object; and removing the bombsight from the aperture of the vacuum fixture.

19. The method of claim 18, wherein the center mark and the first, second, third, fourth, fifth, and sixth plurality of marks each comprise a recess on an outer surface of the second end.

20. The method of claim 19, wherein the center mark and the first, second, third, fourth, fifth, and sixth plurality of marks each comprise a reflective paint in the recess.

* * * * *